United States Patent [19]

Alexandrovich et al.

[11] Patent Number: 4,480,022

[45] Date of Patent: Oct. 30, 1984

[54] METHOD FOR FORMING A SELF-FIXED IMAGE ON A NONPOROUS SURFACE AT AMBIENT TEMPERATURE

[75] Inventors: Peter S. Alexandrovich; Stewart H. Merrill, both of Rochester, N.Y.

[73] Assignee: Eastman Kodak Company, Rochester, N.Y.

[21] Appl. No.: 424,725

[22] Filed: Sep. 27, 1982

[51] Int. Cl.[3] ..... G03G 13/20

[52] U.S. Cl. ..... 430/119; 427/393.5; 430/114; 430/904

[58] Field of Search ..... 430/117, 115, 118, 119, 430/904

[56] References Cited

U.S. PATENT DOCUMENTS

| | | | |
|---|---|---|---|
| 3,135,695 | 6/1964 | York | 430/115 X |
| 3,535,244 | 10/1970 | Zabiak | 427/393.5 X |
| 3,681,106 | 8/1972 | Burns | 430/120 |
| 3,885,960 | 5/1975 | Anderson | 430/117 X |
| 3,954,640 | 5/1976 | Lu et al. | 430/112 X |
| 3,985,664 | 10/1976 | Sakaguchi et al. | 430/109 |

OTHER PUBLICATIONS

Encyclopedia of Polymer Science, vol. 7, (1968), p. 461.

Martens, Technology of Paints, Varnishes and Lacquers, Krieger Pub. Co., Huntington, N.Y., (1975), pp. 116–117.

*Primary Examiner*—John D. Welsh

*Attorney, Agent, or Firm*—Torger N. Dahl

[57] ABSTRACT

A method for developing an electrostatic latent image on a nonporous surface using a self-fixing liquid developer is described. The developer contains a volatile, electrically insulating carrier, and toner particles, dispersed in the carrier, containing a polymer binder which has a Tg within the range from about −10° C. to 30° C. Upon application of the developer to a latent image and evaporating the liquid carrier from the image, the toner particles fix to the surface without externally applied heat other than from ambient conditions.

12 Claims, No Drawings

METHOD FOR FORMING A SELF-FIXED IMAGE ON A NONPOROUS SURFACE AT AMBIENT TEMPERATURE

This invention relates to an electrographic method employing liquid electrographic developers which self-fix to smooth surfaces at room temperature. In particular, the invention relates to the use in volatile liquid carriers of toners composed of binder polymers whose glass transition temperatures are sufficiently low to provide self-fixing.

In the now well-known area of electrography, image charge patterns are formed on the surface of a suitable dielectric material such as a film or paper support. The charge patterns (also referred to as latent electrostatic images), in turn, are rendered visible by treatment with an electrographic developer containing electroscopic marking particles which are attracted to the charge patterns. These particles are called toner particles.

Two major types of developers, liquid and dry, are employed in the development of the aforementioned charge patterns. The present invention is concerned with processes employing liquid developers. A liquid developer is composed of a dispersion of toner particles in an electrically insulating carrier liquid.

In use, a liquid developer is applied to the surface of a support bearing a charge pattern. The visible image is fixed to the surface generally by heating to temperatures above room temperature to fuse the toner to the support. Alternatively, as described in U.S. Pat. No. 3,954,640 issued May 4, 1976, to C. H. Lu et al, fixing to porous or fibrous supports can be accomplished at room temperature through the use of a low-Tg linear addition polymer toner and a nonvolatile carrier to carry the toner particles into the interstices of the support. In the latter instance, toner adhesion to the substrate is enhanced by entanglement within the pores or fibers of the support. Such developers, however, have been found by the present inventors to be non-self-fixing when employed on nonporous surfaces such as smooth film substrates. These toners simply do not adhere to the film surface at room temperature. Accordingly, it would be desirable to fix a toner to a nonporous surface at ambient (room temperature) conditions such as at temperatures of 30° C. or lower.

In accordance with the present invention, an electrographic method is provided for fixing a toner image on a nonporous surface at room temperature. This process entails the use of a self-fixing developer composition comprising toner particles in which the binder constituent is a polymer dispersed in a volatile, electrically insulating liquid. This polymer, moreover, exhibits a glass transition temperature (Tg) within the range from about −10° C. to about 30° C. For purposes of discussion, the defined binder polymer will be hereinafter referred to as the low-Tg polymer. The method, therefore, comprises:

(a) forming an electrostatic image on a nonporous surface;

(b) developing the image with the aforementioned self-fixing developer composition to form an unfixed image comprising the low-Tg polymer-containing toner and the volatile carrier; and (c) allowing the volatile carrier to evaporate from the unfixed image at ambient temperature, thereby fixing the toner in the image to the nonporous surface.

The present invention is preferably practiced with toners comprised of low-Tg polyesters, particularly certain ionic polyesters described hereinafter and referred to as polyesterionomers.

The low-Tg polymers used in this invention are preferably amorphous. An amorphous polymer is one in which the degree of crystallinity is low, as determined by several well-known procedures. For example, the polymers in the above process, if amorphous, exhibit essentially no melting endotherm and broad, nonsharp X-ray diffraction maxima.

In accordance with the invention, the binder polymers are further characterized by a Tg within the range from about −10° C. to about 30° C. The Tg of the polymer is preferably selected to be below ambient temperature anticipated. In colder environments, polymers with Tg's closer to −10° C. are preferred, whereas in warmer environments, such polymers, as well as polymers with Tg's closer to 30° C., can be employed. Polymers with Tg's below −10° C., moreover, are soft and tacky and images formed therefrom are cohesively weak. The Tg of the present polymers is measured by differential scanning colorimetry (DSC) using an E. I. duPont deNemours Co. Differential Scanning Colorimeter at a 10° C./minute temperature rise.

A variety of low-Tg polymers are employable in the defined developer. Suitable polymers include condensation polymers, as well as addition polymers. Representative polymers include polyesters, polycarbonates, polyamides, for example, polymers made from ethylenediamine and the dimer of oleic acid; polyacrylics such as polymers of esters of acrylic and methacrylic acid; polyolefins; and vinyl polymers such as copolymers of vinyl acetate and vinyl stearate or vinyl caprate.

As above noted, the present polymers exhibit a Tg within the range of −10° C. to 30° C., preferably below ambient temperature. It is within the skill of the art to modify a polymer to achieve desired Tg values. For example, it is well-known that the incorporation of certain monomers into the recurring structure of polymers will lower the Tg of the resulting polymer. In polyesters, the incorporation of lower alkylene dicarboxylice acid residues, containing 3 to 8 carbon atoms including the carbonyl carbon atoms, such as adipic acid or glutaric acid residues, lowers the Tg in accordance with the amount of such incorporated unit. Likewise, the Tg of a preselected polymer can be adjusted to a value within the range set forth by modification of the polymer molecular weight during polymerization.

Preferred polymers include polyesters having a Tg from −10° C. to 30° C., most preferrably from 0° C. to 25° C. Representative preferred polymers—either those initially having Tg's from −10° C. to 30° C., or those which have been modified to have such Tg—include polyesters comprising recurring diol units and recurring ionic diacid units. Representative preferred polyester binders have recurring diol units of the formula:

$$-O-G^1-O-$$

wherein:

$G^1$ represents straight- or branched-chain alkylene having about 2 to 12 carbon atoms or, substituted or unsubstituted, cycloalkylene, cycloalkylenebis(oxyalkylene) or cycloalkylene-dialkylene; and one or more aliphatic, alicyclic or aromatic dicarboxylic acid recurring units. Most preferred polyesters are those which have, in addition, up to 35 mole percent (based on the total moles of diacid units) of ionic diacid units of the structure:

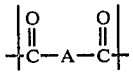

wherein:

A represents sulfoarylene, sulfoaryloxyarylene, sulfocyclohexylene, arylsulfonylimino, sulfonylarylene, iminobis(sulfonylarylene), sulfoaryloxysulfonyl-arylene and sulfoaralkylarylene or the alkali metal or ammonium salts thereof.

Such preferred polyester resins include, for example, the polyester ionomer resins disclosed in U.S. Pat. No. 4,202,785 issued May 13, 1980, to S. H. Merrill et al, incorporated herewith by reference, appropriately modified to have a Tg from −10° C. to 30° C. (in contrast to a Tg of 40° C. and above disclosed in U.S. Pat. No. '785).

Additional preferred polyesters include noncrystalline linear polyesters described in U.S. Pat. No. 4,052,325 issued Oct. 4, 1977, to D. Santilli, the disclosure of which is incorporated herewith by reference. The Tg of some of the polyesters described in U.S. Pat. No. '325 is below room temperature, while others disclosed therein can be modified to exhibit the requisite Tg.

Representative preferred amorphous polyesters in accordance with the present invention are listed in the following Table I:

TABLE I

| Polymer | Tg |
|---|---|
| (1) 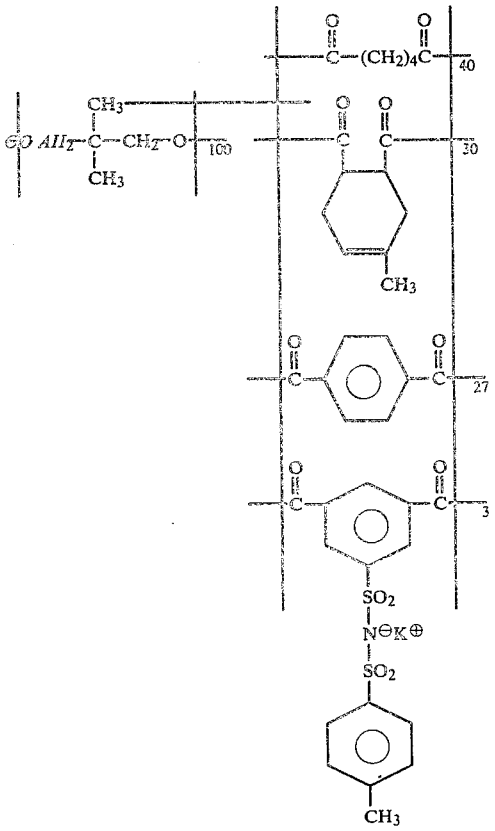 | 0° C. |

TABLE I-continued

| Polymer | Tg |
|---|---|
| (2) 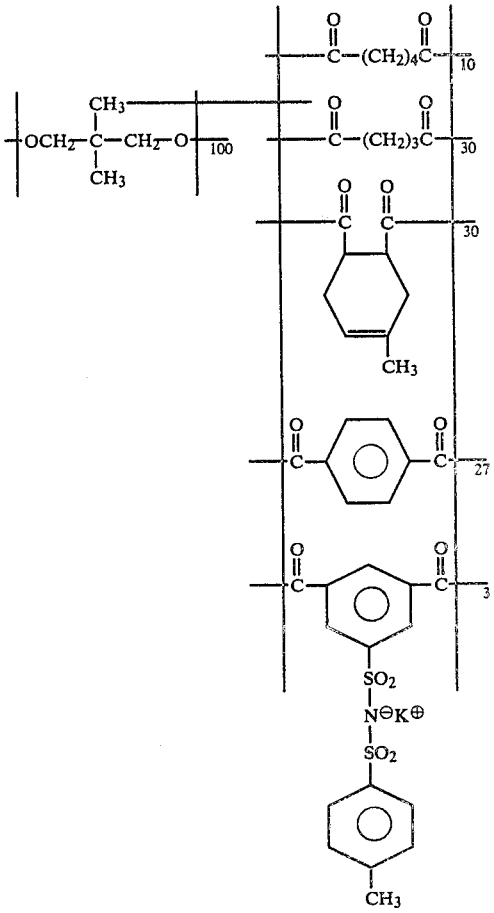 | 7° C. |
| (3) | |

TABLE I-continued
| Polymer | Tg |
|---|---|
| 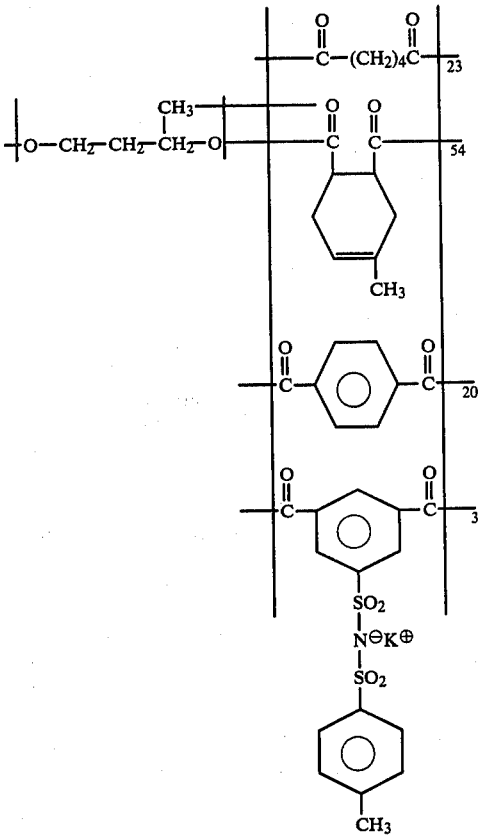 | 7° C. |
(4)
| Polymer | Tg |
|---|---|
| 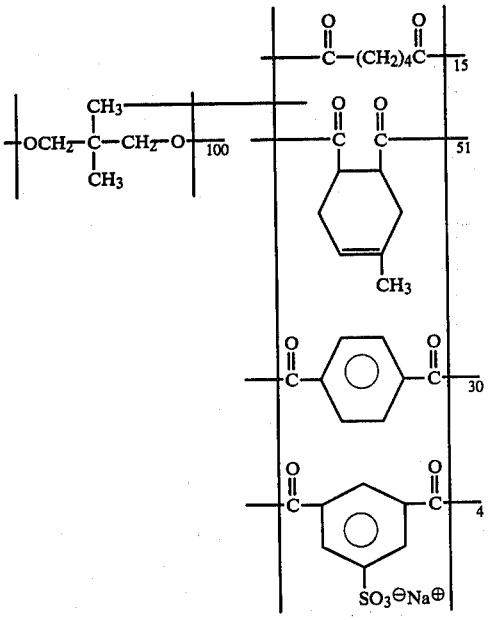 | 27° C. |
(5)
TABLE I-continued
| Polymer | Tg |
|---|---|
| 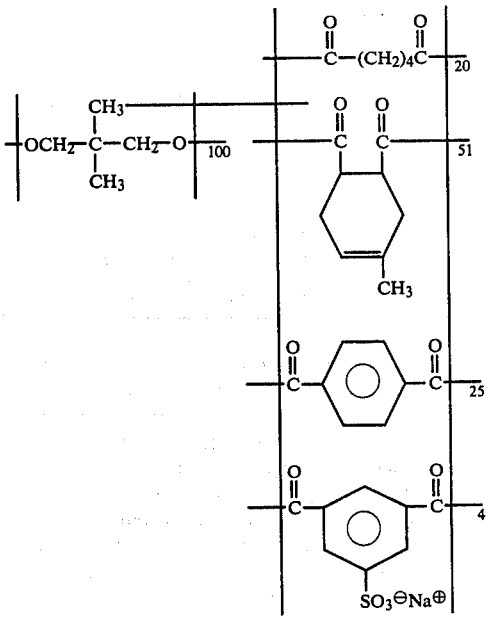 | 23° C. |
(6)
| Polymer | Tg |
|---|---|
| 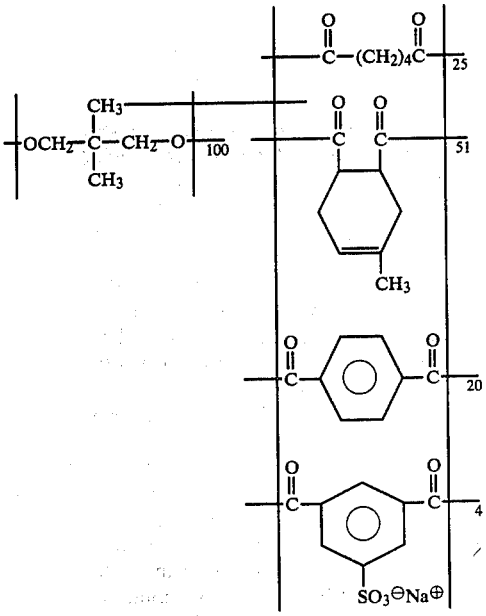 | 17° C. |
(7)

TABLE I-continued

| Polymer | Tg |
|---|---|
| 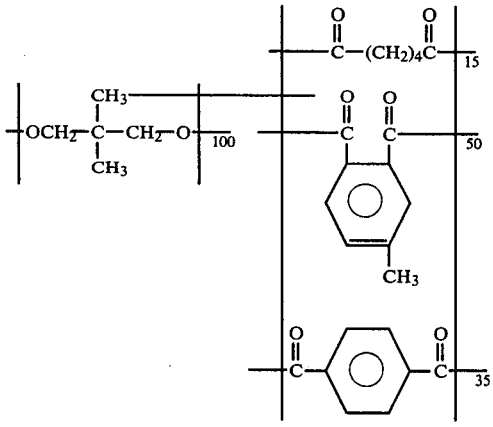 | 25° C. |

The low-Tg polymers herein employed are preferably incorporated into the developer by precipitation of the polymer from a solution of the polymer in an electrically insulating solvent for the polymer. Such precipitation is accomplished, for example, during the preparation of electrographic developer concentrates as defined hereinafter. In the concentrate preparation, the polymer is dissolved in a solvent having the appropriate electrically insulating characteristics. The polymer-solvent solution is thereafter mixed with a larger volume of the electrically insulating carrier liquid in which the polymer is substantially insoluble, causing the polymer to precipitate in the form of small particles. Alternatively, the low-Tg polymer can be precipitated from solution by rapid chilling and the precipitate particles isolated by centrifugation.

Selection of a suitable solvent is based on the low-Tg polymer chosen. The criteria for selection consist of the following: the solvent is capable of dissolving the polymer, and the solvent is electrically insulating as defined with respect to the volume resistivity of the carrier liquid below.

In a preferred embodiment low-Tg polyesters are employed, in which case suitable solvents include chlorinated hydrocarbons such as methylene chloride and alkylated aromatics such as Solvesso 100®. Preferably, the volatility of the solvent is comparable to that of the carrier liquid.

The carrier liquid employed according to the present invention is selected from a variety of materials which are volatile at room temperature or below. These materials should be electrically insulating and have a dielectric constant less than about 3.

The term "volatile" as employed herein signifies that the liquid carrier is capable of substantially complete evaporation from the surface of a toner image-bearing element during use. For example, when an electrostatic image on a film surface is contacted with a developer of the present invention, a visible image of toner particles containing the low-Tg polymer will form on the film. In addition to toner, the film surface also contains residual carrier liquid associated with both the toner and background areas of the image. For purposes of the invention, the residual carrier must be capable of evaporating within about 60 seconds at ambient temperature. In this regard, it will be appreciated that the volatility of a liquid is not dependent solely on its boiling point as there are liquids with high boiling points which volatilize more rapidly than low-boiling-point liquids.

Useful carrier liquids have a dielectric constant of less than about 3, a vapor pressure at 25° C. of more than 1 mm mercury, and a volume resistivity greater than about $10^{10}$ ohm/cm. Suitable carrier liquids include volatile halogenated hydrocarbon solvents, for example, fluorinated lower alkanes, such as trichloromonofluoromethane and trichlorotrifluoroethane. Preferred solvents are volatile isoparaffinic hydrocarbons having a boiling range of from about 145° C. to about 185° such as Isopar G (a trademark of the Exxon Corporation) or cyclohydrocarbons, such as cyclohexane.

In general, developers which are useful for the present invention contain from about 0.5 to about 4 percent by weight of the defined low-Tg polymers, based on the total developer. These developers contain from about 99.5 to about 96 percent by weight of the volatile liquid-carrier vehicle.

Although it is possible to use the liquid developers of the present invention without further addenda, it is often desirable to incorporate in the developer such addenda as charge control agents, colorants and dispersing agents for the colorants.

If a colorless image is desired, it is unnecessary to add any colorant. In such case, the resultant developer composition comprises the liquid-carrier vehicle and the toner particles of the present invention.

In accordance with a preferred embodiment of the present invention, however, colorants such as carbon black pigments are also included as a toner constituent with the defined low-Tg toner polymer in the liquid developer. A representative list of colorants are found, for example, in *Research Disclosure,* Vol. 109, May, 1973, in an article entitled "Electrophotographic Elements, Materials and Processes".

The colorant concentration, when colorant is present, varies widely with a useful concentration range, by weight of the total dispersed constituents, being about 10 to about 90 percent. A preferred concentration range is from about 35 to about 45 percent by weight, based on the dispersed constituents.

Optionally, the developers of the present invention include a charge control agent to enhance uniform charge polarity on the developer toner particles.

Various charge control agents have been described heretofore in the liquid-developer art and are useful in the developers of the present invention. Examples of such charge control agents may be found in Stahly et al U.S. Pat. No. 3,788,995 issued Jan. 29, 1974, which describes various polymeric charge control agents. Other useful charge control agents include phosphonate materials described in U.S. Pat. No. 4,170,563 and quaternary ammonium polymers described in U.S. Pat. No. 4,229,513.

Various nonpolymeric charge control agents are also useful, such as the metal salts described by Beyer, U.S. Pat. No. 3,417,019 issued Dec. 17, 1968. Other charge control agents known in the liquid-developer art may also be employed.

A partial listing of preferred representative polymeric charge control agents for use in the present invention includes styrene-acrylic copolymers such as poly(styrene-co-lauryl methacrylate-co-sulfoethyl methacrylate), poly(vinyltoluene-co-lauryl methacrylate-co-lithium methacrylate-co-methacrylic acid), poly(styrene-co-lauryl methacrylate-co-lithium sulfoethyl methacrylate), poly(vinyltoluene-co-lauryl methacrylate-co-lithium methacrylate), poly(styrene-co-lauryl methacrylate-co-lithium methacrylate), poly(t-butylstyrene-co-lauryl methacrylate-co-lithium methacrylate, poly(t-butylstyrene-co-lithium methacrylate or poly(-vinyltoluene-co-lauryl methacrylate-co-methacryloyloxyethyltrimethylammonium p-toluene sulfonate).

The amount of charge control agent used will vary depending upon the particular charge control agent and its compatibility with the other components of the developer. It is usually desirable to employ an amount of charge control agent within the range of from about 0.01 to about 10.0 weight percent based on the total weight of a working-strength liquid developer composition. The charge control agent may be added in the liquid developer simply by dissolving or dispersing the charge control agent in the volatile liquid-carrier vehicle at the time concentrates of the components are combined with the liquid-carrier vehicle to form a working-strength developer.

Various techniques are employed to prepare a working-strength developer comprising the aforementioned low-Tg polymers. For example, as disclosed by Merrill et al in U.S. Pat. No. 4,202,785, one or more developer concentrates are prepared for each of the developer components. (A concentrate is a concentrated solution or dispersion of one or more developer components in a suitable volatile, electrically insulating liquid vehicle not necessarily the developer carrier liquid.) The concentrates are then admixed in a preselected sequence, the admixture slurried with the carrier liquid to dilute the components, and the slurry homogenized to form the working-strength developer.

The present liquid developers are employed to develop electrostatic charge patterns carried by various types of elements on which the surface to be developed is smooth, nonporous and, hence, impermeable to the developer carrier fluid. Such elements are either photoconductive themselves or are adapted to receive charge images, as disclosed by Gramza et al U.S. Pat. No. 3,519,819 issued July 7, 1970. For example, the developers are employed with a photoconductive film element whose surface is coated with a nonporous arylmethane photoconductor composition such as disclosed by Contois et al U.S. Pat. No. 4,301,226 issued Nov. 17, 1981.

The terms "self-fixing" or "self-fixed" as employed herein refer to the adhesion of the toner image to a smooth surface after the carrier has been evaporated at room temperature. A self-fixed image is rub-resistant and will not freely transfer to other contiguous surfaces. The adhesion of low-Tg polymers to the smooth surface is at least sufficient to resist removal by handling, thus providing an imaged element which is immediately usable. In contrast, under the same development and evaporation conditions, a toner polymer which has a Tg greater than 30° C., or which is employed with a nonvolatile carrier, will not adhere to a smooth surface; a sweep of a finger with light pressure over the image will remove the toner. A toner polymer with a Tg below −10° C., moreover, while adherent, is too soft to be considered useful for normal handling.

The adhesion of the present low-Tg toner polymers is also measurably better under room temperature development conditions and no other externally applied heat. For example, the adhesion of toner images in Dmax regions can be subjected to finger-rubbing with finger pressure varying from light to moderate to heavy pressure. The ease with which the image is removed at each finger pressure is then noted, thus producing the following rank order of adhesion:

1. Image rubs off easily with light pressure.
2. Image rubs off with difficulty with light pressure.
3. Image rubs off easily with moderate pressure.
4. Image rubs off with difficulty with moderate pressure.
5. Image rubs off easily with heavy pressure.
6. Image rubs off with difficulty with heavy pressure.
7. Image is essentially rub-resistant.

The following examples are provided to aid in the understanding of the present invention.

Toner Polymer Preparation

A. A control polymer having a Tg of 49° C. and the following structure was prepared:

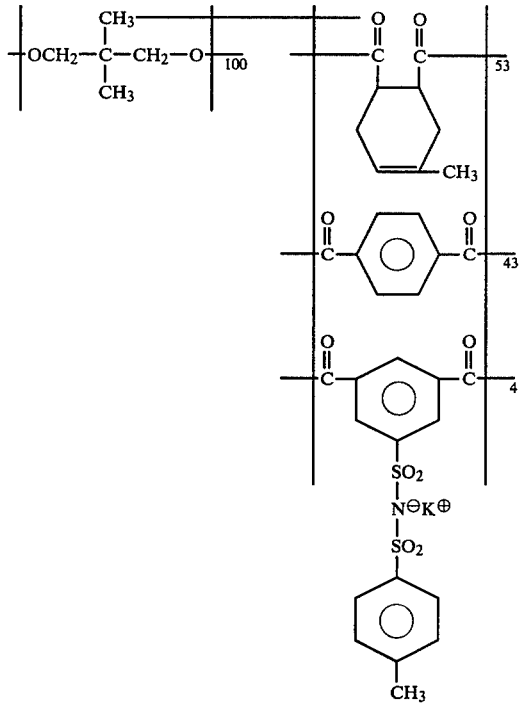

The following materials were charged to a polymerization flask:

| | |
|---|---|
| 88 gms (.53 mole) | 4-methylcyclohexene dicarboxylic anhydride |
| 84 gms (.43 mole) | dimethyl terephthalate |
| 18 gms (.04 mole) | dimethyl 5-(N—potassio-p-toluenesulfonamidosulfonyl)isophthalate |
| 125 gms (1.2 moles) | neopentyl glycol |
| 10 drops | tetraisopropyl ortho-titanate |

The mixture was heated under nitrogen at 220° C. for 2 hr to evolve water and methanol. The temperature was raised to 240° C. for 1 hr, then vacuum was applied, with stirring, to polymerize it for 1½ hr at 240° C. The inherent viscosity of the product was 0.12.

B. Polymers 1–6 of Table 1 were prepared in the same manner as the control polymer. Table II illustrates the amounts of monomer employed in the preparation of three of the polymers (Polymers 1–3). To the constituents shown below in Table II, 2 drops of tetraisopropyl orthotitanate were added to respective polymerization flasks and polymerization was carried out to the inherent viscosity shown.

TABLE II

| Polymer | Glutaric Acid | Adipic Acid | 4-Methyl-cyclohexenedi-carboxylic Anhydride | Dimethyl tereph-thalate | Dimethyl-5-(N—potassio-p-tol-uenesulfonamido-sulfonyl Isophthalate | Neopentyl Glycol | 1,3-butane-diol | I.V. | Tg |
|---|---|---|---|---|---|---|---|---|---|
| 1 | — | 8.8 gms (.06 mole) | 7.5 gms (.045 mole) | 7.8 gms (.04 mole) | 2.1 gms (.0045 mole) | 21 gms (.2 mole) | — | .17 | 0° C. |
| 2 | 2.0 gms (.015 mole)* | 6.6 gms (.045 mole)* | 7.5 gms (.045 mole) | 7.8 gms (.04 mole) | 2.1 gms (.0045 mole) | 21 gms (.2 mole) | | 0.1 | 7° C. |
| 3 | — | 15.3 gms (.034 mole) | 5.3 gms (.092 mole) | 7.7 gms (.039 mole) | 2.3 gms (.005 mole) | — | 23 gms (.25 mole) | 0.1 | 7° C. |

Developer Preparation

Working-strength liquid electrographic developers were prepared containing the control polymer or the low-Tg Polymers 1–6 (Table I) as dispersed toner constituents in an Isopar G® combined volatile liquid carrier. The preparation of the developer proceeded in two stages: in the first stage, the control binder or any one of Polymers 1–6 were dissolved in Solvesso 100® solvent in a concentration of 10 percent polymer, by weight of solution. To 1.5 liters of Isopar G® in an homogenizer were added 12.6 grams of the binder-solvent solution, along with additional Solvesso 100® concentrates containing other developer components. The other concentrates included 11.4 grams of a carbon black and stabilizer material concentrate, 6.1 grams of blue pigment and stabilizer material concentrate, and 1.8 grams of charge control polymer concentrate. The concentrates were then homogenized to form a control developer and six self-fixing developers containing the low Tg polymers dispersed in the Isopar G®, as well as pigments, stabilizer and charge control agent.

EXAMPLES 1–6

The control developer and developers containing Polymers 1–6 were employed to develop electrostatic images on a Kodak Ektavolt recording film. Such films comprise a resinous layer of photoconductor compounds overlaying a conductive film support. The films were charged initially to +500 volts and exposed to neutral-density test targets at a distance of 33 inches from the film for 5 seconds. The exposed films were immersed in the developers for 10–30 seconds and the resulting images air-dried for about 1 minute. The images were subjected to the rank-ordered, finger-rubbing test described above. The results of this test are reported in Table III.

TABLE III

| Example | Polymer | Rub-Resistance Rating $D_{max}$ Image Regions |
|---|---|---|
| control | control | 1 |
| 1 | 1 | 6 |
| 2 | 2 | 7 |
| 3 | 3 | 7 |
| 4 | 4 | 6 |
| 5 | 5 | 6 |
| 6 | 6 | 7 |

Examples 1–6 indicate Polymers 1–6 to be highly self-fixing while the control polymer was not. Developers containing Polymer 7 are expected also to be self-fixing.

Although the invention has been described in considerable detail with particular reference to certain preferred embodiments thereof, variations and modifications can be effected within the spirit and scope of the invention.

We claim:

1. An electrographic method of forming a self-fixed toner image on a film surface comprising:
   (a) forming a latent electrostatic image on said surface;
   (b) developing said image with a liquid electrographic developer comprising:
      (1) a volatile, electrically insulating liquid carrier and
      (2) toner particles, dispersed in said carrier, comprising a polymer having a glass transition temperature within the range from about −10° C. to about 30° C., to form an unfixed toner image comprising said toner and said volatile carrier, and
   (c) allowing said volatile carrier to evaporate from said toner image in the absence of externally applied heat other than that from ambient conditions, thereby fixing said toner to said film surface.

2. The method of claim 1 wherein said polymer comprises a polyester and wherein said glass transition temperature is below ambient temperature.

3. The method of claim 2 wherein said polyester has a Tg in the range from about 0° C. to about 10° C.

4. The method of claim 2 wherein said polyester comprises a recurring diol unit of the formula:

$$-O-G^1-O-$$

wherein:

$G^1$ represents straightor branched-chain alkylene having about 2 to 12 carbon atoms or, substituted or unsubstituted, cycloalkylene, cycloalkylenebis-(oxyalkylene) or cycloalkylene-dialkylene; and having up to 35 mole percent (based on the total moles of diacid units) of ionic diacid units of the formula:

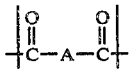

wherein:

A represents sulfoarylene, sulfoaryloxyarylene, sulfocyclohexylene, arylsulfonylimino, sulfonylarylene, iminobis(sulfonylarylene), sulfoaryloxysulfonylarylene and sulfoaralkylarylene or the alkali metal or ammonium salts thereof.

5. The method of claim 4 wherein said polyester additionally comprises one or more alkylene dicarboxylate recurring units containing from 3 to 8 carbon atoms.
6. The method of claim 2 wherein said polymer is selected from the group consisting of:
| Polymer | Tg |
|---|---|
| (1) 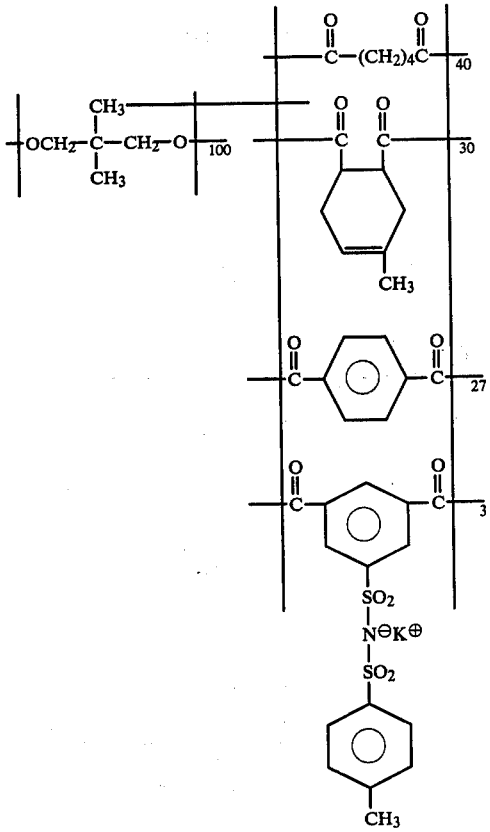 | 0° C. |
| (2) | |
-continued
| Polymer | Tg |
|---|---|
| (3) 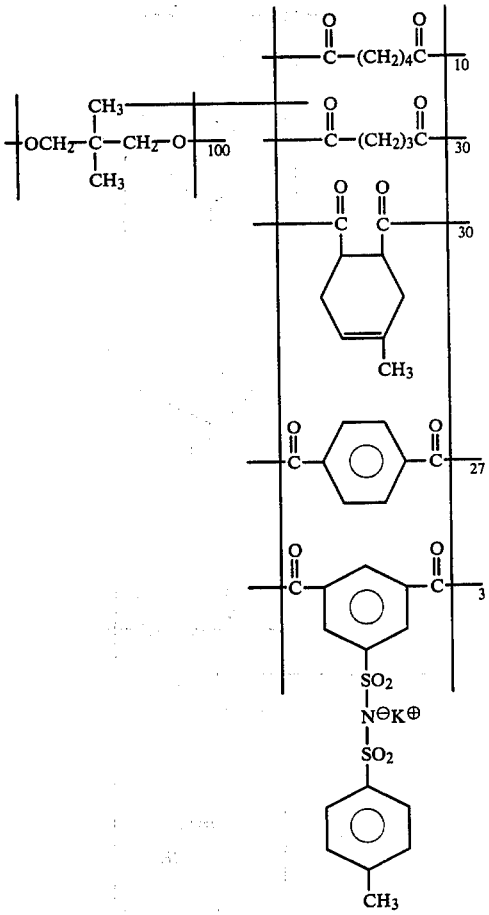 | 7° C. |

-continued
| Polymer | Tg |
|---|---|
| 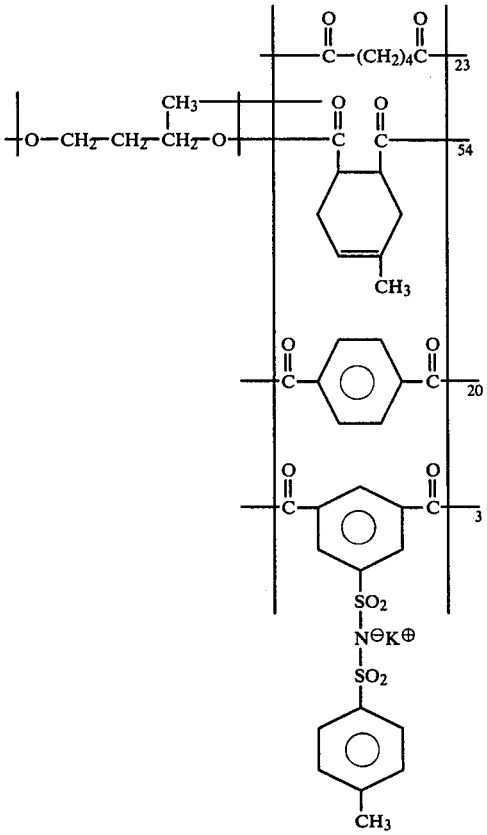 | 7° C. |
(4)
| Polymer | Tg |
|---|---|
| 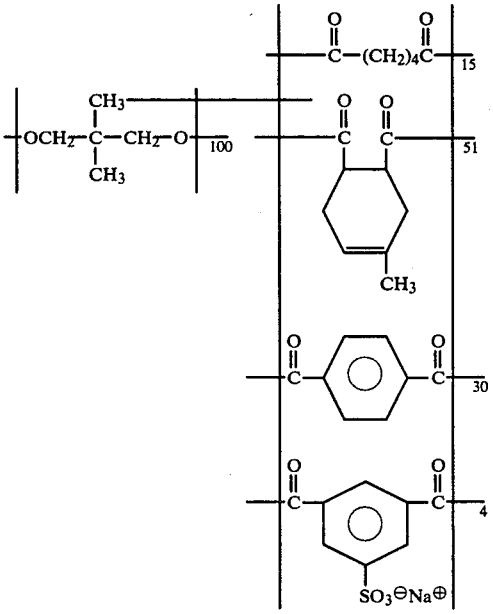 | 27° C. |
(5)
-continued
| Polymer | Tg |
|---|---|
| 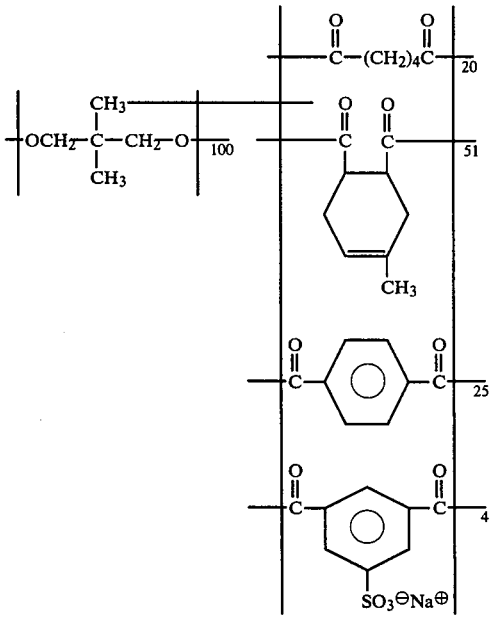 | 23° C. |
(6)
| Polymer | Tg |
|---|---|
| 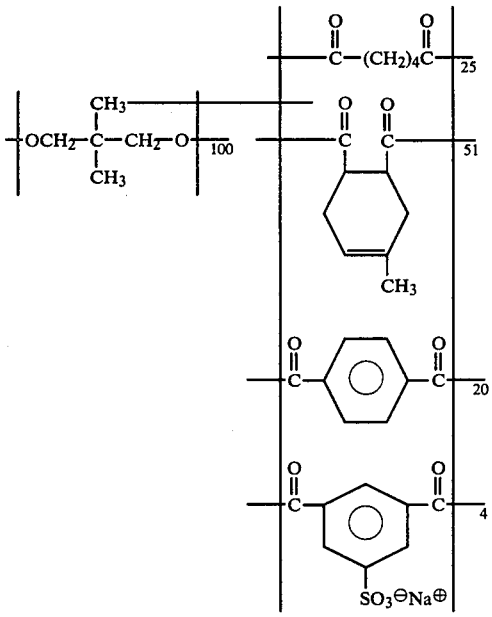 | 17° C. |
(7)

-continued

| Polymer | Tg |
|---|---|
| 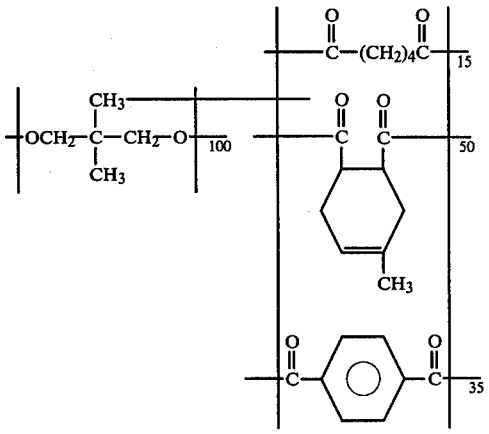 | 25° C. |

7. The method of claim 1 wherein said carrier is capable of evaporating from said toner image in less than 1 minute at room temperature.

8. The method of claims 4 or 7 wherein said carrier is an isoparaffinic hydrocarbon and said solvent for said polymer is an alkylated aromatic liquid.

9. The method of claims 1, 5 or 7 wherein said developer additionally comprises a colorant and a charge control agent.

10. The method of claims 1 or 5 wherein the concentration of said polymer is from about 0.5 to about 4 percent, by weight of total developer.

11. The method of claims 1 or 8 wherein said polymer comprises an acrylic polymer.

12. An electrographic method of forming a self-fixed toner image on a film surface comprising:

(a) forming a latent electrostatic image on said surface;

(b) developing said image with a liquid electrographic developer comprising:

(1) a volatile, electrically insulating, isoparaffinic hydrocarbon liquid carrier and (2) toner particles, dispersed in said carrier, comprising an amorphous polyester and having a Tg within the range from about −10° C. to about 30° C., to form an unfixed toner image comprising said toner and said volatile carrier; and (c) allowing said volatile carrier to evaporate from said toner image in the absence of externally applied heat other than that from ambient conditions, thereby fixing said toner to the surface of said film.

* * * * *